US009885185B2

(12) United States Patent
Steffes et al.

(10) Patent No.: US 9,885,185 B2
(45) **Date of Patent: *Feb. 6, 2018**

(54) PANEL SIDING PRODUCT

(71) Applicant: CERTAINTEED CORPORATION, Malvern, PA (US)

(72) Inventors: Stephen W. Steffes, McPherson, KS (US); Robert D. Shaw, Parma, MI (US); Brian W. Kirn, Hatboro, PA (US); David J. Stucky, Grass Lake, MI (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/340,237

(22) Filed: Nov. 1, 2016

(65) Prior Publication Data

US 2017/0114548 A1 Apr. 27, 2017

Related U.S. Application Data

(63) Continuation of application No. 14/568,429, filed on Dec. 12, 2014, now Pat. No. 9,482,011.
(Continued)

(51) Int. Cl.
*E04F 13/08* (2006.01)
*E04F 13/073* (2006.01)

(52) U.S. Cl.
CPC ..... *E04F 13/0864* (2013.01); *E04F 13/0733* (2013.01); *E04F 13/0871* (2013.01)

(58) Field of Classification Search
CPC .... E04F 13/26; E04F 13/0864; E04F 13/0871
See application file for complete search history.

(56) References Cited

U.S. PATENT DOCUMENTS 1,315,260 A 9/1919 Tischler
1,366,175 A 1/1921 Hansen
(Continued)

FOREIGN PATENT DOCUMENTS

AU 545365 7/1985
CA 2593188 1/2008
(Continued)

OTHER PUBLICATIONS

Technical Search, 4 pgs. Sep. 2012.
(Continued)

*Primary Examiner* — Patrick J Maestri
(74) *Attorney, Agent, or Firm* — Abel Law Group, LLP; Alexander H Plache

(57) ABSTRACT

A siding product may include a panel having a substantially rectangular structure with a simulated pattern on a front face thereof. The panel may be formed from a polymer and may include color variegation. The panel may have a hollow back and be a single shake configuration that does not simulate more than one shake or more than one course of siding. The siding product may include a panel having a front face with a simulated pattern. The panel can include a hollow back, a longitudinal length extending in an x-direction, a lateral width extending in a y-direction, and a transverse depth extending in a z-direction. The panel can have a plurality of reinforcement ribs on the hollow back that extend longitudinally in the x-direction and transversely in the z-direction. In a version, none of the reinforcement ribs extend laterally in the y-direction.

16 Claims, 7 Drawing Sheets

Related U.S. Application Data

(60) Provisional application No. 61/917,398, filed on Dec. 18, 2013.

(56) References Cited

U.S. PATENT DOCUMENTS 1,404,483 A 1/1922 Scharwarth et al.
1,414,483 A 5/1922 Novitzky
2,168,218 A 8/1939 Kirschbraun
2,252,539 A 8/1941 Adams
2,735,143 A 2/1956 Kearns
2,753,143 A 7/1956 Berit
3,200,547 A 8/1965 Johnson
3,444,657 A 5/1969 Swanson
3,579,940 A 5/1971 Greenleaf
3,593,479 A 7/1971 Hinds et al.
3,720,031 A 3/1973 Wilson et al.
3,852,931 A 12/1974 Kirkhuff
3,852,934 A 12/1974 Kirkhuff
3,943,677 A 3/1976 Carothers
4,015,391 A 4/1977 Epstein
4,128,369 A 12/1978 Kemerer et al.
4,299,792 A 11/1981 Nunn
4,306,848 A 12/1981 Nunn
4,308,702 A 1/1982 Rajewski
4,395,376 A 7/1983 Matthews
4,835,925 A 6/1989 Hoffmann
4,930,287 A * 6/1990 Volk ..... E04F 13/18 264/145
4,972,647 A 11/1990 Meldrum
D316,299 S 4/1991 Hurlburt
5,150,555 A 9/1992 Wood
5,232,751 A 8/1993 Cameron et al.
5,295,340 A 3/1994 Collins
5,517,794 A 5/1996 Wagner
5,615,523 A 4/1997 Wells et al.
5,711,126 A 1/1998 Wells
5,743,059 A 4/1998 Fifield
5,902,683 A 5/1999 Sieloff
5,946,877 A 9/1999 Gallinat et al.
5,956,914 A 9/1999 Williamson
5,974,748 A 11/1999 Sciuga et al.
5,992,116 A 11/1999 Ternes et al.
6,021,611 A 2/2000 Wells et al.
6,046,265 A 4/2000 Clark et al.
6,112,492 A 9/2000 Wells et al.
6,125,602 A 10/2000 Freiborg et al.
6,224,701 B1 5/2001 Bryant et al.
6,261,074 B1 7/2001 Clark et al.
6,332,296 B1 12/2001 Moscovitvh
6,345,479 B1 2/2002 Hutchinson et al.
D454,648 S 3/2002 Shaw et al.
6,418,692 B1 7/2002 Freshwater et al.
6,421,975 B2 7/2002 Bryant et al.
6,530,189 B2 3/2003 Freshwater et al.
6,684,587 B2 2/2004 Shaw et al.
6,715,250 B2 4/2004 Bryant et al.
6,827,995 B2 12/2004 Hughes et al.
6,872,438 B1 3/2005 Allgeuer
6,883,282 B1 4/2005 Newhart
6,946,182 B1 9/2005 Allgeuer et al.
6,955,019 B2 10/2005 Donlin et al.
7,207,145 B2 * 4/2007 Stucky ..... E04F 13/0864 52/520
7,587,864 B2 9/2009 McCaskill
7,587,871 B2 9/2009 Perry
D618,367 S 6/2010 Schwarz et al.
7,735,286 B2 6/2010 Trabue et al.
7,735,287 B2 * 6/2010 Gaudreau ..... E04D 1/265 52/525
7,926,227 B2 4/2011 Mower et al.
7,980,037 B2 * 7/2011 Trabue ..... E04D 1/265 52/302.1
8,020,353 B2 9/2011 Gaudreau
8,033,064 B2 10/2011 Guadreau
D648,038 S 11/2011 Gaudreau
8,074,417 B2 * 12/2011 Trabue ..... E04D 1/265 52/302.1
8,136,316 B2 3/2012 Schwarz et al.
8,136,322 B2 3/2012 Shadwell et al.
8,151,530 B2 * 4/2012 Schwarz ..... E04F 13/0864 52/314
8,153,045 B2 4/2012 Boor
8,209,938 B2 7/2012 Gaudreau et al.
8,261,505 B2 9/2012 Kalkanoglu et al.
8,371,081 B2 2/2013 Bennett et al.
8,375,663 B2 2/2013 Johnston et al.
8,407,962 B2 4/2013 Cahill et al.
8,453,410 B2 6/2013 Kalkanoglu et al.
8,516,765 B2 8/2013 Shaw et al.
8,572,921 B2 11/2013 Ward et al.
8,590,270 B2 11/2013 Martinique
8,601,764 B2 12/2013 Cahill et al.
8,677,709 B2 3/2014 DiLonardo et al.
8,850,771 B2 10/2014 Jenkins et al.
2001/0037617 A1 11/2001 Chi
2001/0041256 A1 11/2001 Heilmayr
2002/0121057 A1 9/2002 Steffes
2004/0074175 A1 4/2004 Tierney
2005/0072092 A1 4/2005 Williams
2005/0089672 A1 4/2005 Kuipers et al.
2005/0153103 A1 7/2005 Meyer et al.
2005/0153122 A1 7/2005 Detterman
2006/0013994 A1 1/2006 Burke
2006/0026908 A1 2/2006 Gregori et al.
2006/0130419 A1 6/2006 Bowman
2007/0045887 A1 3/2007 Boor
2007/0119107 A1 5/2007 Shaw et al.
2008/0010924 A1 * 1/2008 Pietruczynik ..... B29C 47/0028 52/309.1
2008/0083186 A1 4/2008 Gaudreau
2008/0236064 A1 10/2008 Sippola
2009/0084058 A1 4/2009 Cahill et al.
2009/0293401 A1 12/2009 Lappin
2010/0011690 A1 1/2010 Schwarz et al.
2010/0032861 A1 2/2010 Pietruczynik
2010/0088988 A1 4/2010 Gaudreau
2010/0107530 A1 5/2010 Pietruczynik
2010/0129622 A1 5/2010 Kalkanoglu
2011/0023392 A1 2/2011 Rosenthal
2011/0023396 A1 2/2011 Schwarz et al.
2011/0036040 A1 2/2011 Child
2011/0061323 A1 3/2011 Schwarz et al.
2011/0185665 A1 8/2011 Allen
2011/0265417 A1 11/2011 Trabue et al.
2012/0031012 A1 2/2012 Bonshor
2012/0085053 A1 4/2012 Barone
2012/0117906 A1 5/2012 Moller, Jr. et al.
2012/0117908 A1 5/2012 Turek et al.
2012/0193826 A1 8/2012 Boor
2012/0285109 A1 11/2012 Mollinger et al.
2012/0324812 A1 12/2012 Robertson
2013/0122269 A1 * 5/2013 Bourgeois ..... B32B 27/065 428/215
2014/0227478 A1 8/2014 Stucky et al.
2014/0272273 A1 9/2014 Shaw et al.
2015/0167313 A1 6/2015 Steffes et al.
2015/0298374 A1 10/2015 Steffes et al.

FOREIGN PATENT DOCUMENTS

CA 2683214 1/2008
CA 2729386 7/2011
CA 160070 8/2015
CN 101568421 7/2008
EP 0046003 2/1982
EP 1504164 10/2012
EP 1937456 10/2013
GB 2050929 1/1981
JP 2009505872 2/2009
JP 2009222437 10/2009
JP 4842322 12/2011
KR 20080064812 7/2008

(56) References Cited

FOREIGN PATENT DOCUMENTS

| | | |
|---|---|---|
| WO | 9922092 | 5/1999 |
| WO | 03095760 | 11/2003 |
| WO | 2005070670 | 8/2005 |
| WO | 2007027874 | 3/2007 |
| WO | 2012009329 | 1/2012 |
| WO | 2012067699 | 5/2012 |
| ZA | 8105013 | 8/1982 |

OTHER PUBLICATIONS

VS-09504-US Technical Search, 7 pgs, 2014.
CT 17 Clearance search results, 2 pgs, 2013.
http://barringtonrooftiles.com.au/home.html.
http://www.maibec.com/en/products/individual-shingles-eastern-white-cedar-shingles.
http://www.absolutegreenhomes.com/TransformationsProductsRoofing.html.
http://www.architectmagazine.com/products/exterior-products-review-synthetic-roofing.aspx.
http://www.authenticroof.com/.
http://www.bellafortebydavinci.com/.
http://www.bobvila.com/articles/composite-shingles/.
http://www.davinciroofscapes.com/products-shake.php.
http://www.ecostarllc.com/index.aspx.
http://www.inspireroofing.com/.
http://www.jameshardie.com/homeowner/landing-hardieshingle.shtml.
http://www.newtechshingles.com/.
http://www.nucedar.com/products/sidings.
http://www.oldhouseweb.com/how-to-advice/synthetic-slate-fabulous-fakes.shtml.
Technical Search, 1 pg, 2014.

* cited by examiner

PANEL SIDING PRODUCT

CROSS-REFERENCE TO RELATED APPLICATION(S)

This application is a continuation and claims priority to U.S. patent application Ser. No. 14/568,429 entitled "PANEL SIDING PRODUCT", by Stephen W. STEFFES, filed Dec. 12, 2014, which application claims priority under 35 U.S.C. § 119(e) to U.S. Patent Application No. 61/917,398 entitled "PANEL SIDING PRODUCT", by Stephen W. STEFFES, filed Dec. 18, 2013, of which both applications are assigned to the current assignee hereof and incorporated herein by reference in their entirety.

BACKGROUND OF THE INVENTION

Field of the Disclosure

The present invention relates in general to building products and, in particular, to a panelized siding product.

Description of the Related Art

Natural material such as wood shake is used as a building product to cover a substrate of a building, such as a wall. The wood shake provides the function of covering and protecting the wall of the building. In addition, the wood shake has an aesthetically appealing appearance.

Wood shake is traditionally formed from wood such as cedar. Wood shake is relatively expensive to produce because it requires harvesting and splitting of wood, which is time consuming, labor intensive, and results in excess unused wood that is not suitable for shake.

In addition, wood shake is relatively expensive and labor intensive to install. Several individual pieces of wood shake are first mounted to the substrate in a row. Care is taken to space each of the wood shake from each to accommodate for expansion and retraction of the wood shake due to atmospheric changes. A layer of felt is then mounted to the substrate overlapping a portion of the row of wood shake. Then a second row of wood shake is mounted to the substrate overlapping the felt such that the felt interleaves the two rows of shake. This configuration is repeated such that several rows of wood shake interleaved with felt cover the substrate.

With wood shake, the interleaved felt is intended to prevent wind and blowing precipitation from blowing between adjacent pieces of wood shake and below overlapping pieces of wood shake. As such, the felt reduces water logging of the wood shake and water intrusion to the substrate and acts as an insulator. However, as stated above, the material and installation associated with the interleaved felt is relatively expensive and labor intensive.

In addition, attempts to produce polymeric building products to have an appearance that simulates the look of natural material have had limited success. In particular, improvements in the texture and color of the polymeric building product continue to be of interest. Accordingly, improvements in building products that simulate natural materials continue to be of interest.

SUMMARY

Embodiments of a panelized siding product are disclosed. The siding product may include a panel having a plurality of simulated courses of simulated shingles including a front, back, top, bottom and sides. A hanger clip extends forward and downward from adjacent the top of the panel. The hanger clip comprises a single hanger clip that extends continuously substantially from side to side of the panel. A butt leg extends rearward and upward from adjacent the bottom of the panel. The butt leg of an upper panel is configured to engage the hanger clip of a lower panel in two courses of panels. The hanger clip of the lower panel and the butt leg of the panel directly engage each other without the need of an additional component.

In another embodiment of a siding product, a panel having a plurality of simulated courses of simulated shingles includes a front, back, top, bottom and sides. A hanger clip extends from the front of the panel. A butt leg extends from the back of the panel and is configured to engage the hanger clip of a lower panel in two courses of panels. A plurality of hammer positioning pads (HPP) extend from the panel and are spaced apart from the hanger clip. Versions of the HPP do not contact the hanger clip. The HPP are configured to be impacted by a hammer to adjust a position of the panel on a structure from side to side.

In still another embodiment, a siding product may comprise a panel having a front with a simulated wood grain, a hollow back opposite the front, a longitudinal length extending in an x-direction, a lateral width extending in a y-direction, and a transverse depth extending in a z-direction. The panel can have a hanger clip on the front that has a hanger clip length that extends longitudinally in the x-direction. The hanger clip length is at least about 50% of the longitudinal length of the panel. A butt leg is located on the hollow back. The butt leg of the panel may be configured to engage the hanger clip of a lower panel without interlocking, such that they do not engage each other with positive snap action engagement.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments as understood by those of ordinary skill in the art.

The use of the same reference symbols in different drawings indicates similar or identical items.

DETAILED DESCRIPTION

Figure 1:
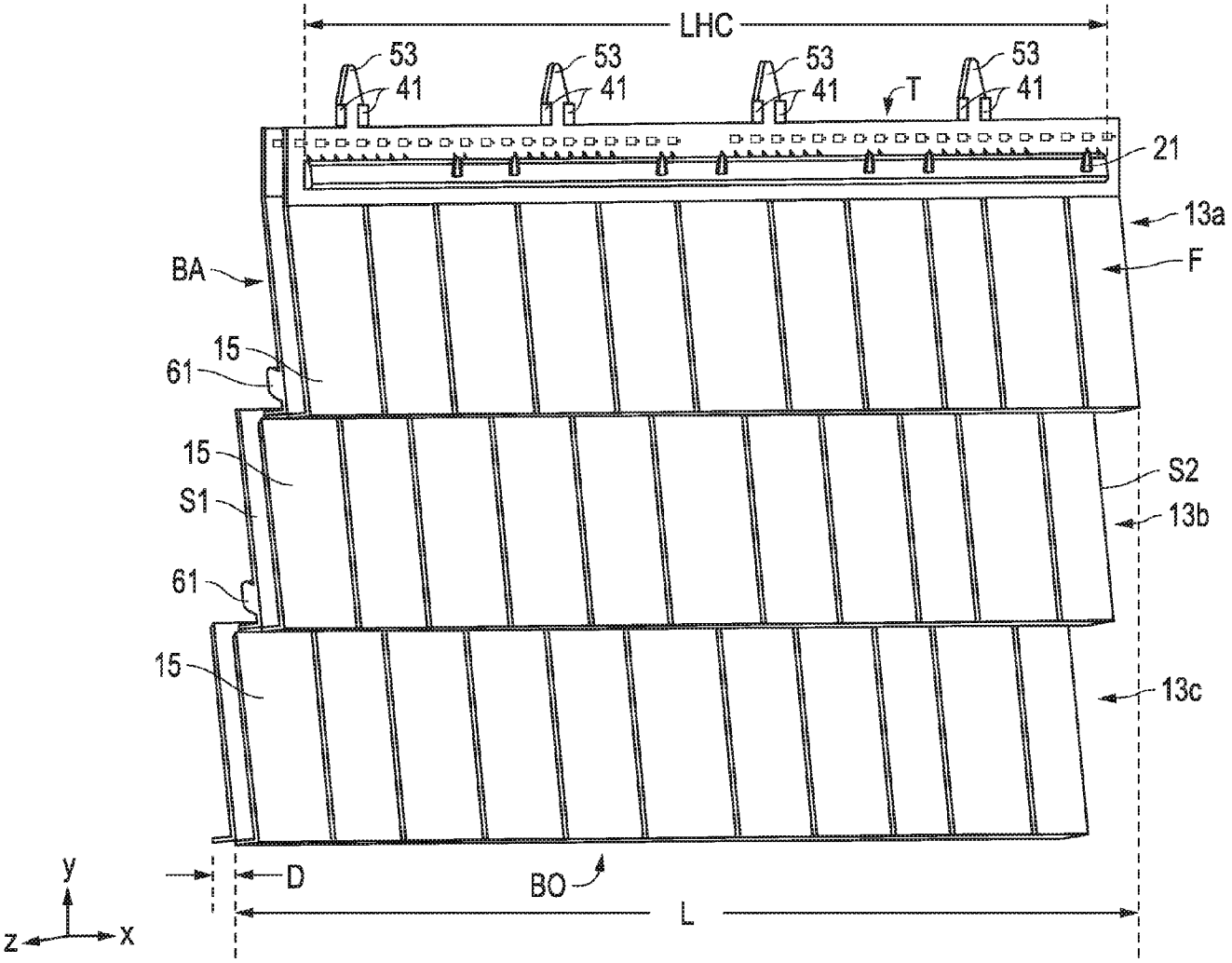
FIG. 1 is a front isometric view of an embodiment of siding product.

Embodiments of a system, method and apparatus for a siding product are disclosed. The siding product is not a roofing product, nor does it comply with roofing product standards. As shown in FIG. 1, the siding product may include a panel 11. The panel comprise a variety of materials, such as a rigid polymer material. The panel 11 may include a front F, a back BA, a top T, a bottom BO and two sides S1, S2. Embodiments of the front F of the panel 11 may include a simulated pattern. For example, the front F may include a simulated wood grain or simulated slate. In a version, the back BA may be configured as a hollow back configuration.

Embodiments of the panel may include a plurality of simulated courses 13 (e.g., three horizontal courses 13*a*, 13*b*, 13*c* are shown). Each course 13 may include a plurality of simulated shingles 15 (e.g., eleven shingles in each course 13). The panel 11 can have a nominal wall thickness of not greater than about 0.110 inches, such as not greater than about 0.100 inches, or even not greater than about 0.090 inches. The nominal wall thickness can be at least about 0.070 inches, such as at least about 0.080 inches. The nominal wall thickness can be in a range between any of these values.

Figure 2:
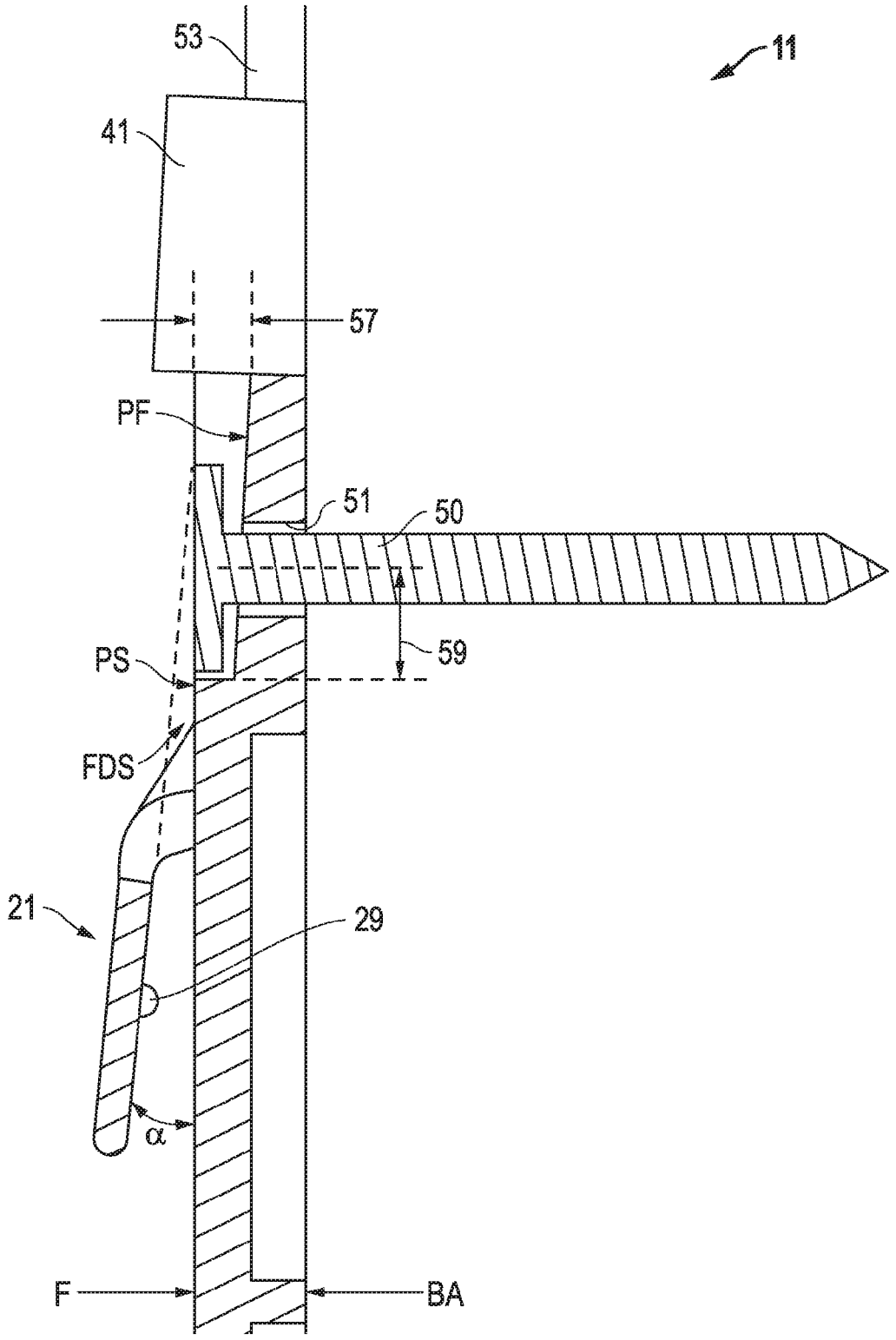
FIG. 2 is an enlarged sectional side view of an upper portion of an embodiment of a siding product.
Figure 3:
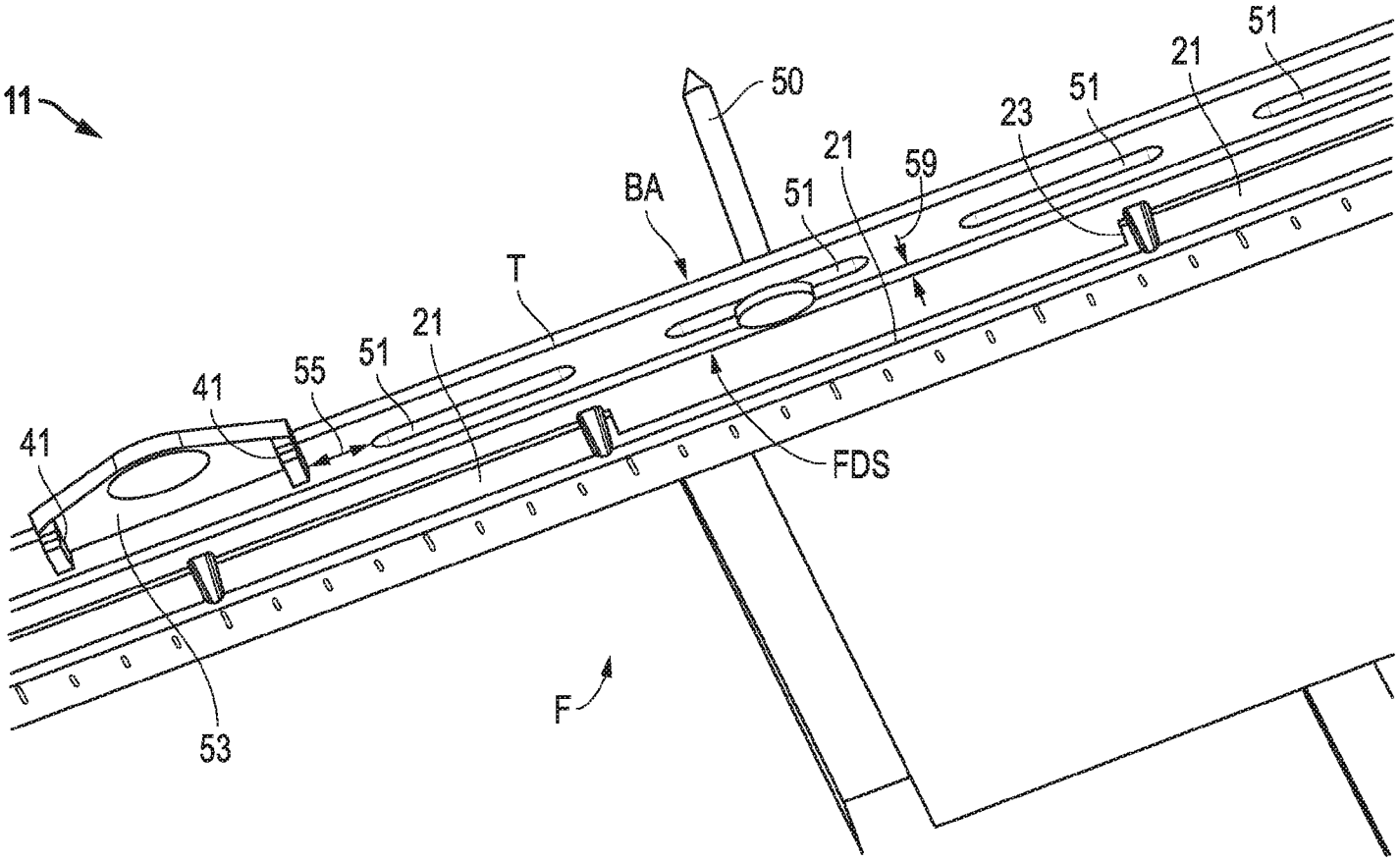
FIG. 3 is an enlarged top-front isometric view of an upper portion of an embodiment of a siding product.

In some embodiments, a hanger clip 21 extends from the panel 11. As shown in FIGS. 2 and 3, the hanger clip 21 may be located adjacent the top T of the panel 11. The hanger clip 21 may extend as a forward extension 25 from the front F, and as a downward extension 27 from the forward extension 25. Such a configuration of hanger clip 21 may comprise a female receptacle. The downward extension 27 may form an angle $\alpha$ relative to the front F of the panel 21. For example, angle $\alpha$ may be less than about 10 degrees or, in another embodiment, not greater than about 5 degrees.

Embodiments of the hanger clip 21 may comprise a single hanger clip, rather than a plurality of discrete hanger clips as in is known in the art. The hanger clip 21 can extend continuously across panel 11, and substantially from side S1 to side S2 of the panel 11. The hanger clip 21 may be considered 'continuous' since it may consist of a single integrated clip, rather than a plurality of 'discontinuous' (i.e., detached and spaced-apart) hanger clips as is known in the art. The hanger clip 21 may be provided with apertures 23 (FIG. 3) therein.

Embodiments of the panel 11 may include a longitudinal length L (FIG. 1) extending in an x-direction (see, e.g., Cartesian coordinate system x-y-z). The panel 11 may further include a lateral width W extending in a y-direction, and a transverse depth D extending in a z-direction. Versions of the hanger clip 21 may include a hanger clip length LHC that extends longitudinally in the x-direction. In an embodiment, the hanger clip length LHC can be at least about 50% of the longitudinal length L of the panel 21. In other embodiments, the LHC can be at least about 60%, at least about 70%, at least about 80%, at least about 90%, or even at least about 95% of the longitudinal length L of the panel 21. The LHC can be in a range between any of these values.

Figure 4:
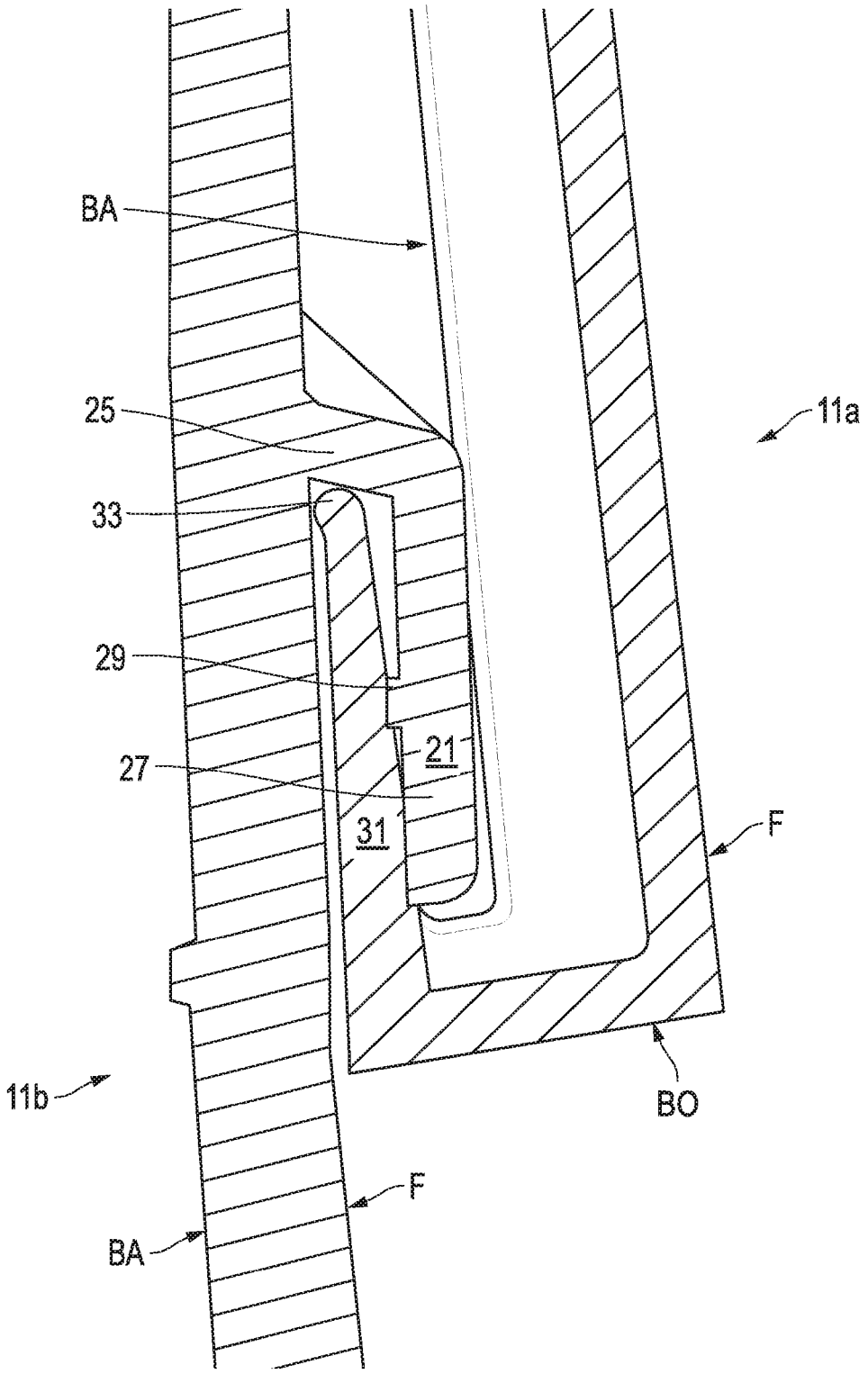
FIG. 4 is an enlarged side view of an engagement between an embodiment of two siding products.
Figure 5:
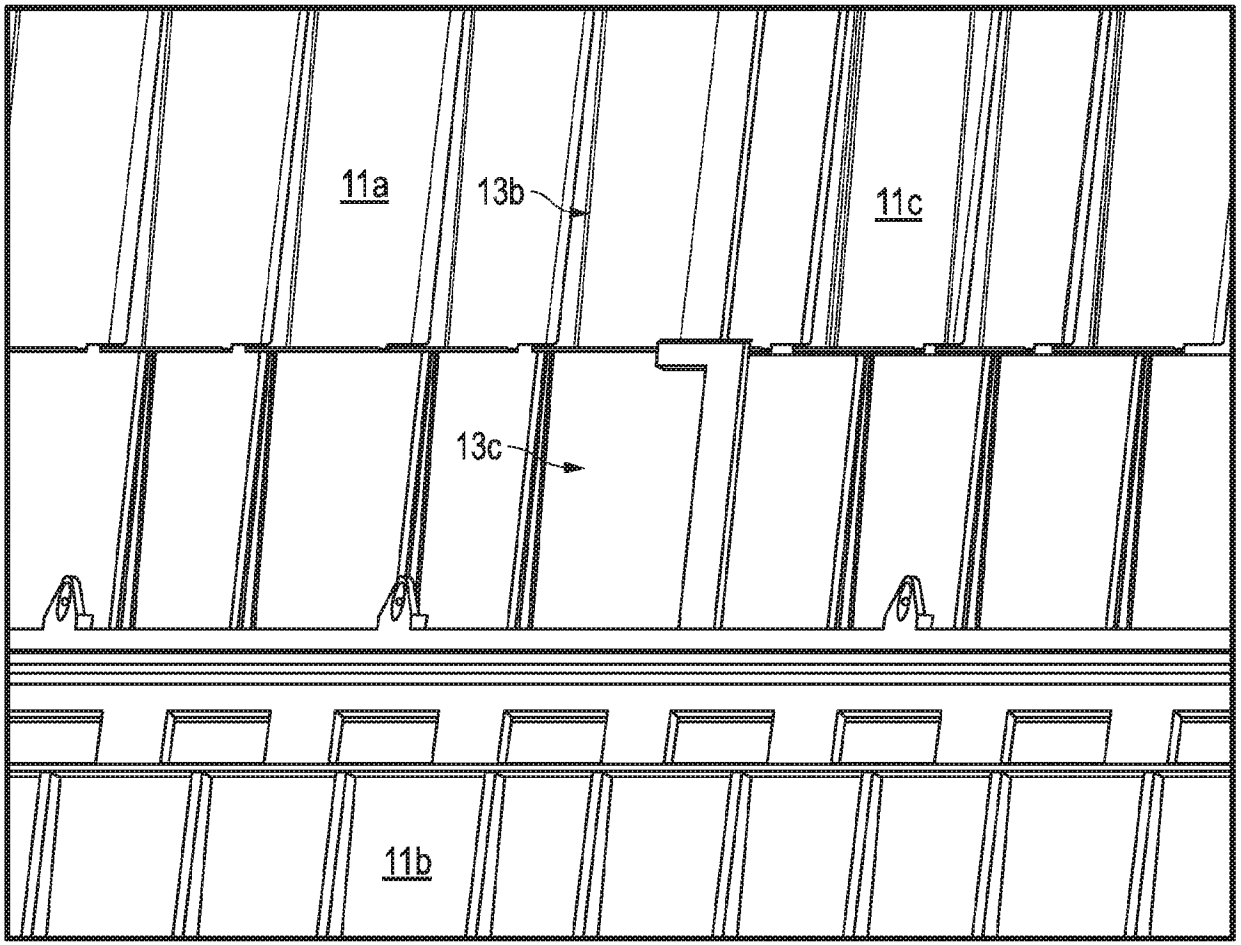
FIG. 5 is an enlarged rear isometric view of an engagement of an embodiment of three siding products.

Embodiments of the panel 11 may further include a butt leg 31. As shown in FIGS. 4 and 5, the butt leg 31 may extend rearward from back BA and upward from adjacent the bottom BO of the panel 11. Such a configuration of butt leg 31 may comprise a male extension. In an embodiment, the butt leg 31 of an upper panel 11*a* may be configured to couple with and engage the hanger clip 21 of a lower panel 11*b* in two courses of panels 11*a* and 11*b*. A panel 11*c* also is shown in FIG. 5, in the same course as panel 11*a*. The butt leg 31 and the hanger clip 21 can be substantially parallel to each other and the front F of the panels 21. The butt leg 31 and hanger clip 31 can be skew to each other and/or to the front F of the panels 21. In one version, the hanger clip 21 of the lower panel 11*b* and the butt leg 31 of the upper panel 11*a* directly engage each other without the need of an additional component. For example, U.S. Pat. No. 8,407,962 requires an additional "u-shaped member" (i.e., a third component) to complete the union between two of its panels.

In some embodiments, the butt leg 31 of the upper panel 11*a* may be configured to engage the hanger clip 21 of a lower panel 11*b* without interlocking, such that they do not engage each other with positive snap action engagement. In contrast, U.S. Pat. No. 7,980,037 requires both interlocking and positive snap engagement. In other embodiments, the hanger clip 21 of the lower panel 11*b* and the butt leg 31 of the upper panel 11 may be configured to only engage each other with friction. In some versions, the panel 11 does not have an aperture adjacent the hanger clip 21 that is configured to receive a lip edge 33 (FIG. 4) of the butt leg 31.

As described herein, the hanger clip 21 may include a forward extension 25 and a downward extension 27 extending from the forward extension 25. The downward extension 27 may comprise interface protrusions 29 on an interior, rearward facing surface thereof. The interface protrusions 29 may provide an interference fit between hanger clip 21 and butt leg 31. In some examples, the interface protrusions 29 may comprise hemispherical or cylindrical dimples. In other examples, the interface protrusions 29 may comprise elongated ribs.

As shown in FIGS. 1-3, embodiments of the panel 11 may further include a plurality of hammer positioning pads (HPP) 41. The HPP 41 may extend from the panel 11 and may be spaced apart from the hanger clip 21. Versions of the HPP 41 do not contact the hanger clip 21. The HPP 41 may be configured to be horizontally impacted (i.e., toward side S1 or toward side S2) by a hammer to adjust a position of the panel 11 on a structure from side to side prior to fastening the panel to the structure. The panel 11 may be considered 'self-supporting' on the structure prior to fastening due to the friction and/or interference fit between the hanger clip 21 on an already-installed lower course of panel 11, and the butt leg 31 on an upper course of a non-yet-fastened panel 11.

In an embodiment, the HPP 41 comprise rectangular pads that extend forward from the front F of the panel 11. The HPP 41 may be vertically oriented, as shown. In other versions, the HPP 41 may be horizontally oriented (not shown). The HPP 41 can be substantially perpendicular to the front F of the panel 11. In an example, the HPP comprise at least about 4 HPP and not greater than about 20 HPP. In another example, the HPP 41 may comprise about 0.25 HPP per foot of length L of the panel 11, to about 2 HPP per foot of length L of the panel 11.

Embodiments of the HPP 41 may comprise grouped pairs of adjacent HPP 41, as shown in FIG. 3. In a version, the HPP 41 in a grouped pair of HPP 41 may be spaced apart from each other by at least about 0.25 inches, and not greater than about 2 inches. Each grouped pair of adjacent HPP 41 may be spaced apart from other ones of the grouped pairs of adjacent HPP 41, as shown in FIG. 1. For example, the grouped pairs of HPP 41 may be spaced apart from each other by at least about 4 inches, and not greater than about 12 inches.

Embodiments of the HPP 41 may be located adjacent the top T of the panel 21. In a particular version, the panel 11 can have a plurality of top tabs 53 extending from the top T thereof at an uppermost portion of the panel 11. The HPP 41 can extend forward from the top tabs 53, as shown.

As shown in FIG. 2, a bottom of the HPP 41 can be co-planar with a top of a fastener slot 51 of the panel 11. In another embodiment, the HPP 41 can be displaced or spaced apart longitudinally by a distance 55 (FIG. 3) from an adjacent fastener slot 51 by at least about 0.25 inches.

In some embodiments, the fastener slot 51 can have a fastener plane of reference PF (FIG. 2). The fastener slot 51 may be provided with only one fastener depth stop (FDS) that abuts or is adjacent to the fastener slot 51. The only one fastener depth stop FDS may be located below the fastener slot 51, as shown. The only one fastener depth stop FDS can be an only obstruction to the fastener slot 51, such that the fastener slot 51 is unobstructed above and to the sides thereof. Optionally, a collective overall length of the fastener depth stop FDS may be substantially equal to the length LHC of the hanger clip 21.

In a version, the only one FDS may comprise a stop plane of reference PS that is displaced forward from the fastener plane of reference PF by a distance 57 that is approximately equal to or greater than the thickness of a conventional nail head. For example, the distance 57 can be at least about 0.030 inches, and not greater than about 0.125 inches. In another embodiment, a center of the fastener slot 51 may be spaced apart from the FDS by a distance 59. The distance 59 may be vertical, as shown in FIG. 2, and may comprise about one-half diameter of a fastener head. For example, the distance 59 may comprise at least about 0.25 inches.

Figure 6:
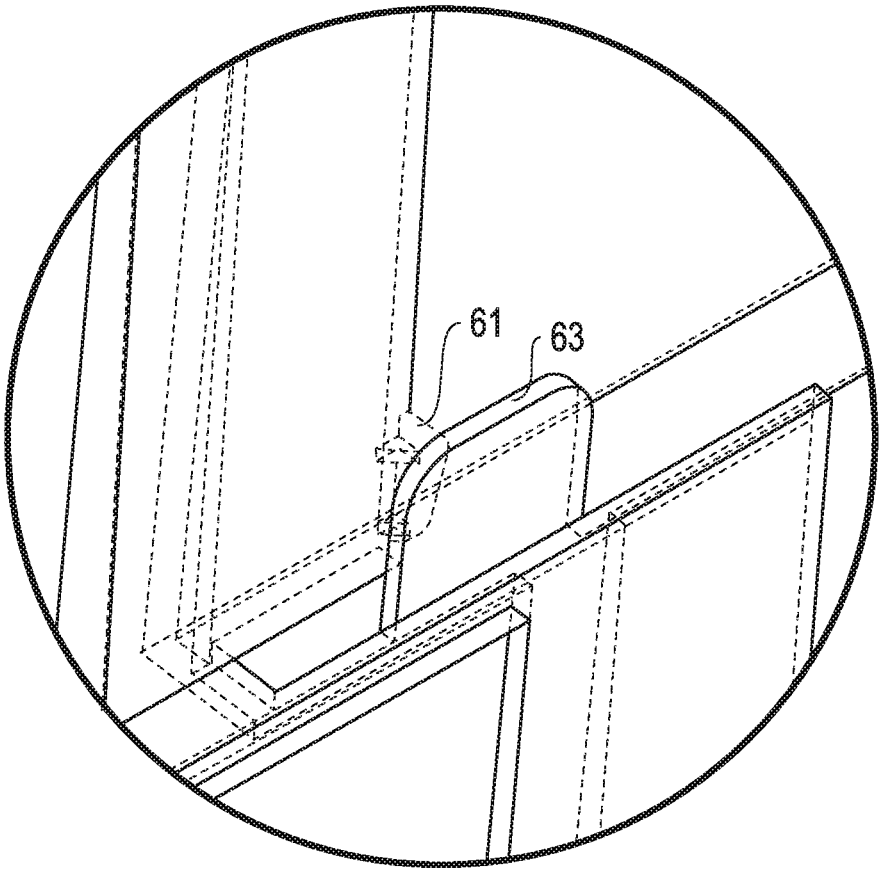
FIG. 6 is a further enlarged, opposite rear isometric view of an engagement of an embodiment of two siding products.

Referring to FIGS. 1 and 6, embodiments of the panel 11 may further include one or more male and female side tabs 61, 63. Tabs 61, 63 would normally appear in FIG. 5, but were removed to simplify the drawing. Each of the male and female side tabs 61, 63 may have a substantially planar orientation. In one version, the male and female side tabs 61, 63 are substantially perpendicular to each other (FIG. 6). In some versions, the male and female side tabs 61, 63 are configured to have an interference fit. In some versions, the interference fit may be configured to permit laterally adjacent panels to be vertically adjusted (i.e., slight vertical movement) relative to each other, rather than horizontally adjusted (i.e., slight horizontal movement) relative to each other. See, e.g., U.S. Pat. No. 7,207,145, which is incorporated herein by reference in its entirety.

As described herein, the panel 11 may comprise three simulated courses 13*a*, 13*b*, 13*c* (FIGS. 1 and 5) of simulated shingles 15. Course 13*a* may be designated as an upper course, course 13*b* may be designated as a center course, and course 13*c* may be designated as a lower course. Embodiments of the panel 11 may include one or more male tabs 61 adjacent one side 51 of one or more of the courses 13*a*, 13*b*, 13*c*. Embodiments of the panel 11 also may include one or more female side tabs 63 adjacent an opposite side S2 of the one or more courses 13*a*, 13*b*, 13*c*.

Figure 7:
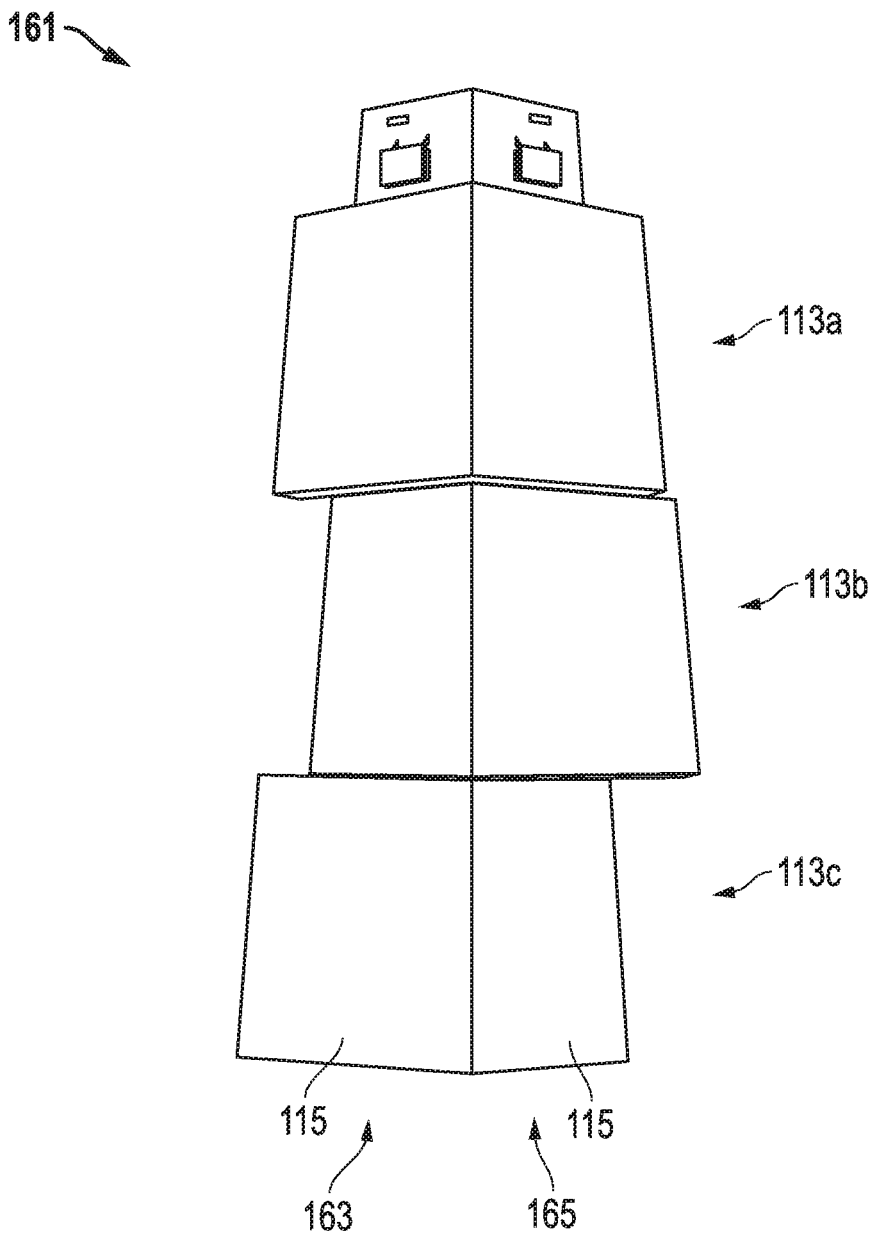
FIG. 7 is a front isometric view of an embodiment of corner siding product.

In still another embodiment (FIG. 7), the panel may comprise a corner panel 161 having substantially perpendicular sections 163, 165 configured to be complementary in shape to a corner of a building. The corner panel 161 may comprise a compound mitre, such that each section 163, 165 of the corner panel 161 is tapered in at least two directions. Like panel 11, panel 161 may comprise three simulated courses 113*a*, 113*b*, 113*c* of simulated shingles 115, as described herein. Embodiments of the corner panel 161 may include offset courses, such as those shown, and/or those depicted in U.S. Pat. No. 6,684,587, which is incorporated herein by reference in its entirety.

Embodiments of the siding product are suitable for weather-protective exterior application in overlapping horizontal courses. The sides and edges of the panels are formed and configured to overlap and interlock with each other, in same and adjacent courses.

Some embodiments of the siding product are not roofing products. For example, the siding product may not be provided with the requisite thickness, strength, impact resistance, roofing code compliance, fire code compliance, etc., to be used as a roofing product. Versions of the siding product are not 'walkable', as is understood in the roofing industry.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A siding product, comprising:

a panel having a plurality of simulated courses of simulated shingles including a front, back, top, bottom and sides;

a hanger clip that extends from the front of the panel;

a plurality of hammer positioning pads (HPP) extending forward from a front of the panel and spaced apart from the hanger clip, the HPP being configured to be impacted by a hammer to adjust a position of the panel on a structure from side to side prior to fastening the panel to the structure; and fastener slots in the panel.

2. The siding product of claim 1, wherein the panel has a longitudinal length extending in an x-direction, a lateral width extending in a y-direction, and a transverse depth extending in a z-direction, and wherein the hanger clip length extends longitudinally in the x-direction.

3. The siding product of claim 1, wherein the front has a simulated wood grain.

4. The siding product of claim 1, wherein the back is hollow opposite the front.

5. The siding product of claim 2, wherein the hanger clip length is at least about 50% of the longitudinal length of the panel.

6. The siding product of claim 4, further comprising a butt leg located on the hollow back configured to engage the hanger clip of a lower panel in two courses of panels.

7. The siding product of claim 6, wherein the butt leg of the panel is configured to engage the hanger clip of a lower panel without interlocking, such that they do not engage each other with positive snap action engagement.

8. The siding product of claim 6, wherein the butt leg and hanger clip are skewed to each other or to the front the panel.

9. The siding product of claim 7, wherein the hanger clip of the lower panel and the butt leg of the upper panel directly engage each other without the need of an additional component.

10. The siding product of claim 6, wherein the hanger clip of the lower panel and the butt leg of an upper panel are configured to only engage each other with friction.

11. The siding product of claim 1, wherein the panel does not have an aperture adjacent to the hanger clip that is configured to receive a lip edge of the butt leg.

12. The siding product of claim 6, wherein the hanger clip includes a forward extension and a downward extension extending from the forward extension where the downward extensions include interface protrusions which are adapted to provide an interference fit between the hanger clip and butt leg.

13. A siding product, comprising:

a panel having a plurality of simulated courses of simulated shingles including a front, back, top, bottom and sides;

a hanger clip that extends from the front of the panel;

a butt leg that extends from the back of the panel and is configured to engage the hanger clip of a lower panel in two courses of panels; and male and female tabs, and the male and female tabs are substantially perpendicular to each other and configured to have an interference fit with respective female and male tabs on adjacent panels.

14. The siding product of claim 13, wherein the tabs are configured to allow for vertical adjustment and horizontal interference fit.

15. The siding product of claim 13, wherein the panel has one or more male tabs adjacent one or more of the courses, and one or more female side tabs adjacent an opposite side of said one or more courses.

16. The siding product of claim 13, wherein the tabs include top tabs extending from the top of the panel at an uppermost portion of the panel.

* * * * *